US007524164B2

(12) United States Patent
Wunderlich et al.

(10) Patent No.: US 7,524,164 B2
(45) Date of Patent: Apr. 28, 2009

(54) ARRANGEMENT FOR THE AUTOMATIC RUNNING GAP CONTROL ON A TWO OR MULTI-STAGE TURBINE

(75) Inventors: Thomas Wunderlich, Berlin (DE); Harald Schiebold, Berlin (DE); Peter Broadhead, Derby (GB)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 531 days.

(21) Appl. No.: 11/088,840

(22) Filed: Mar. 25, 2005

(65) Prior Publication Data

US 2005/0254939 A1 Nov. 17, 2005

(30) Foreign Application Priority Data

Mar. 26, 2004 (DE) ..... 10 2004 016 222

(51) Int. Cl.
*F01D 11/16* (2006.01)
*F01D 9/00* (2006.01)
*F01D 25/26* (2006.01)

(52) U.S. Cl. ..... 415/136

(58) Field of Classification Search ..... 415/127, 415/136, 137, 139
See application file for complete search history.

(56) References Cited

U.S. PATENT DOCUMENTS

| | | | | | |
|---|---|---|---|---|---|
| 2,634,090 | A * | 4/1953 | Hardigg | 415/135 |
| 2,955,800 | A * | 10/1960 | Miller et al. | 415/138 |
| 3,446,481 | A * | 5/1969 | Kydd | 416/92 |
| 4,076,451 | A * | 2/1978 | Jankot | 415/209.2 |
| 4,242,042 | A | 12/1980 | Schwarz | |
| 4,565,492 | A * | 1/1986 | Bart et al. | 415/175 |
| 5,044,881 | A | 9/1991 | Dodd | |
| 5,165,850 | A * | 11/1992 | Humke et al. | 415/209.2 |
| 5,181,826 | A * | 1/1993 | Rock | 415/173.1 |
| 6,340,285 | B1 * | 1/2002 | Gonyou et al. | 415/116 |
| 6,390,771 | B1 * | 5/2002 | Gervais et al. | 415/139 |
| 6,863,495 | B2 * | 3/2005 | Halliwell et al. | 415/173.1 |
| 2003/0146578 | A1 | 8/2003 | Girard | |
| 2004/0219011 | A1 * | 11/2004 | Albers et al. | 415/174.2 |

FOREIGN PATENT DOCUMENTS

| | | |
|---|---|---|
| DE | 3941174 A1 | 7/1990 |
| GB | 886 626 A | 1/1962 |
| GB | 2 061 396 | 5/1981 |
| GB | 2 061 396 A | 5/1981 |
| GB | 22 26 365 A | 6/1990 |
| WO | WO 95 25 879 A | 9/1995 |

* cited by examiner

*Primary Examiner*—Edward Look
*Assistant Examiner*—Nathaniel Wiehe
(74) *Attorney, Agent, or Firm*—Timothy J. Klima

(57) ABSTRACT

On a two or multi-stage turbine, expansion rings are provided in all stages at the sides of the rotors for passive, continuous running gap control whose thermal expansion and contraction behavior corresponds to that of the rotors and which are connected to radially moveable upstream and downstream stator vanes (5, 7). The downstream stator vanes are assembled to the upstream stator vanes via a bridge (16; 17, 18) which is axially and circumferentially fixed and located flexibly in the radial direction on the outer casing (10) of the turbine. The stator vanes (6) arranged between the rotor disks are integrally connected to the bridge or, as separate components, held axially and circumferentially on the bridge to take up rolling and tilting moments.

18 Claims, 5 Drawing Sheets

ARRANGEMENT FOR THE AUTOMATIC RUNNING GAP CONTROL ON A TWO OR MULTI-STAGE TURBINE

This application claims priority to German Patent Application DE 10 2004 016 222.0 filed Mar. 26, 2004, the entirety of which is incorporated by reference herein.

BACKGROUND OF THE INVENTION

This invention relates to an arrangement for automatic—passive—running gap control on a two or multi-stage turbine which comprises at least first and second rotors within an outer casing, with stator vanes arranged upstream, between and downstream of these rotors, respectively.

On the turbine of aircraft engines, the clearance between the blade tips of the rotor and the casing adjacent to it or another stationary component are desirably kept as small as possible to minimize performance and fuel losses and ensure high efficiency of the engine in all flight phases. However, this is problematic in that the rotating and stationary components are subject to different dynamic loads and to different thermal loads, in particular in the various flight phases such as take-off, acceleration, continuous operation or deceleration, with their expansion and contraction characteristics deviating accordingly.

The clearance (running gap, blade gap) between the rotating blade tips and the stationary casing parts adjacent to the blade tips must be large enough to prevent rubbing between the stationary and the rotating components as they expand under transient conditions. Under continuous operating conditions, this clearance will, however, grow to an extent that efficient use of the energy input is not ensured.

In order to keep the running gap as constant and as small as possible in all operating phases to effectively use the energy input while preventing the rotating blade tips of the rotor from contacting the adjacent, stationary area of the casing in the take-off phase, a great variety of solutions for running gap control has been presented.

The known "active" solutions for setting the size of the running gap comprise the supply of cold compressor air or hot combustion gases to the casing or to the liner segments (interlayers) connected to it, using their expansion or contraction to actively control the gap size or adapting the expansion behavior of the stator to the thermal and dynamic expansion behavior of the rotor in the various operating phases.

"Active" systems for running gap control are, however, disadvantageous in that they incur a loss of compressor work or a reduction of turbine efficiency, respectively. Moreover, adequate control of the gap width between blade tips and liner segments is not possible in all operating phases. Finally, active systems are expensive since they require valve and control devices.

In order to resolve the problems associated with active gap control, Specification GB 2061396 proposes an arrangement provided in the casing interior for automatic "passive" running gap control between the blade tips and the liner segments arranged on the inner side of the turbine casing of a single-stage turbine. In the case of this "passive" running gap control, the liner segments, which are arranged remotely above the tips of the rotor blades, are held at the outer platforms of the stator vanes of the turbine on one side and at the outer platforms of a subsequent stator vane on the other side, while the inner platforms of the stator vane segments on both sides are each connected to a ring element (expansion ring) whose reaction to a certain thermal load corresponds to the thermal behavior of the rotor. Thus, in the event of an expansion or a contraction of the rotor, the ring elements connected to the platforms will become larger or smaller to the same extent as the rotor, the moveably held stator vane segments will be shifted and the liner segments attached to the vane segments will be set relatively to the rotor and in correspondence with the degree of expansion and contraction of the rotor.

This design, which also comprises a special fixation of the stator vanes to enable their radial movement, ensures the formation of a constant running gap between blade tips and liner segments in all operating phases of the engine. The arrangement described in the above is, however, unsuitable for two or multi-stage turbines.

Based on the radial setting of the liner segments in accordance with the expansion and contraction behavior of the rotor known from Specification GB 2061396, the present invention, in a broad aspect, provides an arrangement for two or multi-stage turbines for passively setting a running gap that is constant in various operating phases.

BRIEF SUMMARY OF THE INVENTION

It is a particular object of the present invention to provide solution to the above problems by an arrangement for automatically controlling the running gap width on a two or multi-stage turbine designed in accordance with the features described herein. Further features and advantageous embodiments of the present invention will be apparent from the description below.

In accordance with the state of the art, at least one expansion ring is associated with each of the at least two rotors whose expansion and contraction behavior under changing thermal load agrees with that of the rotors. The expansion rings are connected to the stator vanes located immediately upstream and downstream of the turbine, so that the upstream and downstream stator vanes are adjusted in accordance with the thermal load. The outer platforms of the upstream and downstream stator vanes are connected to each other by means of a bridge, which is fixed in the axial and circumferential direction and is moveably located in the radial direction. The intermediate stator vanes are either integrally or separately provided on the moveable bridge between the rotors. The rolling and tilting moments acting upon these are taken up by the axially and circumferentially retained bridge elements and, if applicable, an additional axial attachment on the free vane side. Also provided on the bridge so formed are separate or integral shroud segments.

This type of bridge design provides, for the first time for two or multi-stage turbines, a passive gap width control individually optimised for each rotor stage in accordance with the thermal rotor movement, which, in addition, is less expensive than the active systems hitherto known for gap width control on two-stage turbines.

In accordance with a further important feature of the present invention, the bridge comprises a first half bridge and a second half bridge which is axially, radially and circumferentially held on the first half-bridge and which is integral with the intermediate stator vanes. The first half bridge forms a segmented inner casing of bending-resistant, circumferentially spaced supporting segments, with each supporting segment being firmly connected to a stiff ring attached to the outer casing by means of a radially flexible mounting or link.

However, the first half bridge can also be located slideably in the radial direction on the outer casing by means of a pin and sleeve or other fastening system.

In another development of the present invention, the bridge can include full-bridge elements at which the intermediate stator vanes and the shroud segments are separately held or integrally provided, with the intermediate stator vanes being held on the free side in a circumferential groove. In an embodiment of the present invention, the full-bridge elements are located radially by means of a guiding pin engaging a guiding sleeve.

In yet another embodiment of a full bridge, the individual full bridge elements are connected to the outer casing by means of a radially flexible link. The braces are either held on a fixing ring by means of a groove or immediately connected to a stiff ring attached to the outer casing by means of a flange. In this variant, a supporting segment with integrated stator vane and integrated shroud segment is axially and circumferentially fixed on the bridge elements.

In another development of the present invention, axial location of bridge elements, supporting elements or intermediate stator vanes is accomplished by means of a piston ring-type fixing ring which engages a groove provided in the component to be located.

In a further development of the present invention, the bridges or the half-bridge elements (supporting elements), respectively, and the full-bridge elements are stiffened by reinforcing elements (ribs).

BRIEF DESCRIPTION OF THE DRAWINGS

Embodiments of the present invention are more fully described in the light of the accompanying drawings. In the drawings.

DETAILED DESCRIPTION OF THE INVENTION

Figure 1:
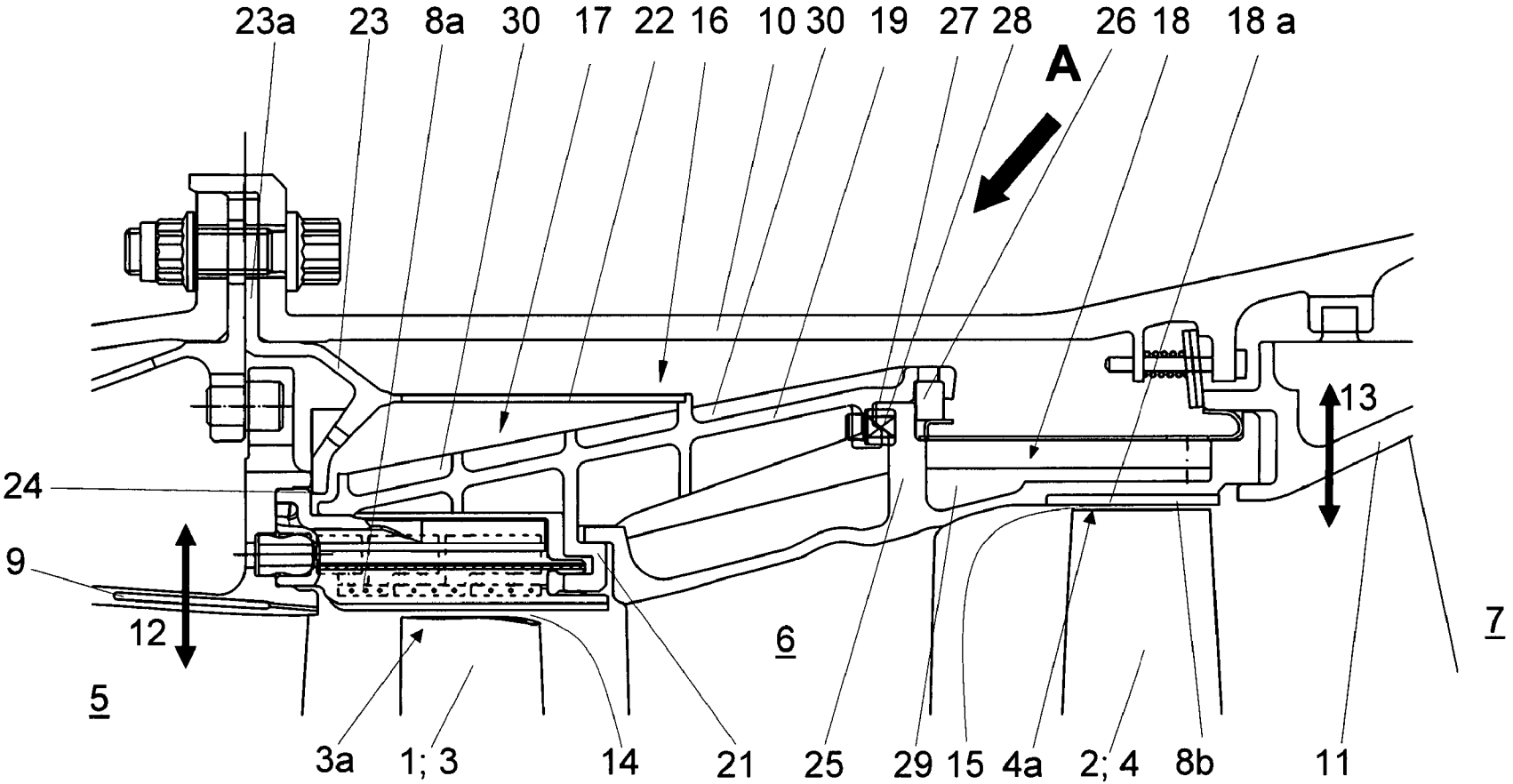
FIG. 1 is a partial view of a two-stage turbine with a two-part bridge which automatically adapts to the expansion behavior of the rotors, with shroud segments held on this bridge, and with an intermediate stator vane.

The two-stage turbine partially shown in FIG. 1 in schematic representation comprises a first rotor 1 and a second rotor 2, each with a row of rotor blades 3 or 4, respectively. A first or second stator vane row with first or second stator vanes 5, 6 respectively, is arranged upstream of the first or second rotor 1, 2, respectively. The principle of radial adjustment of the first and second shroud segments 8*a*, 8*b* forming a first and a second shroud and arranged remotely of the blade tips 3*a*, 4*a* is essentially identical with the design described in Specification GB-A-2061396 and is, therefore, not represented herein. This principle is only explained in that a one-piece expansion ring (not shown) is associated with each of the two rotors 1 and 2 of the two-stage turbine whose expansion behaviour agrees with that of the adjacent rotor 1 or 2, respectively. The expansion ring (not shown) associated with the first rotor 1 is connected to the first stator vanes 5, which are moveably located radially to the respective outer casing 10 of the turbine via the respective outer platform 9 on the turbine inlet side, while the expansion ring (not shown) adjacent to the second rotor 2 is connected to a likewise radially moveable outer platform 11 for a stator vane row (not shown) on the outlet side of the turbine. The respective radial movement of the stator vanes 5 on the inlet side and of the downstream stator vanes 7 on the outlet side is indicated by a double arrow 12 or 13, respectively.

With a first and second running gap 14, 15 being left, the shroud segments 8*a*, 8*b* opposite the blade tips 3*a*, 4*a* are adjusted relative to the blade tips 3*a*, 4*a* in accordance with the movement transmitted by the expansion rings (not shown), on the one hand, onto the moveable first stator vanes 5 and their outer platforms 9 and, on the other hand, to the outer platforms 11 of the downstream stator vanes 7 of the rearward stator vane row and from these to a bridge 16. The bridge 16, which connects the outer platforms 9 of the first (forward) stator vanes 5 with the outer platforms 11 of the rearward (downstream) stator vanes 7, comprises, in the present embodiment, a first half bridge 17 followed by a second half bridge 18. The second half bridge 18 is integrally connected to the intermediate stator vanes 6 and to the second shroud segments 8*b*. The first shroud segments 8*a*, in the present embodiment, are separately manufactured and held on the bottom side of the first half bridge 17 and on the outer platforms 9 of the first stator vanes 5.

The first half bridge 17 includes supporting elements 19 arranged in the circumferential direction and provided with bending resistance by reinforcing elements 30. A circumferential gap 20 is left between two each supporting elements 19. A mount 21 provided on the supporting element 19 serves for both, location or retention of the first shroud segments 7 and axial and radial retention of the inflow-side end of the second half bridge 18 with integrated shroud segments 8 and second stator vanes 6. Connected to the side of the circumferentially spaced, bending-resistant supporting elements 19 which faces the outer casing 10 are thin, radially flexible links 22 which, at the free end, transit into a circumferential, one-piece, stiff attaching ring 23 whose angled mounting flange 23*a* with holes 23*b* serves for firm connection to the outer casing 10. On the side of the supporting element 19 resting on the outer platform 9 of the stator vanes 5, a radial gap 24 exists between the stiff supporting element 19 and the stiff attaching ring 23 so that, by virtue of the flexible connection via the braces 22 and the supporting elements 19 being interrupted by the circumferential gaps 20, radial movement between the attaching ring 23 and the supporting elements 19 is possible, but with the loads produced by the stator vanes 6 of the second turbine stage being axially and circumferentially transmittable.

The second half bridge 18, which circumferentially includes half-bridge elements 18*a* and to which the second stator vanes 6 of the turbine arranged upstream of the second rotor 2 and the second shroud segments 8*b* are attached, is radially held, on the outlet-side end, on the outer platforms 11 of the stator vanes (not shown) arranged behind (downstream of) the second rotor 2. The second half bridge 18 locates, on a web 25 connected to each half-bridge element 18*a*, the outlet-side end of the circumferentially spaced supporting elements 19 of the half bridge 17 by means of a one-piece, slotted fixing ring 26 in the axial direction, by means of an abutment 27 in the radial direction, and by means of locating pins 28 in the circumferential direction.

Figure 2:
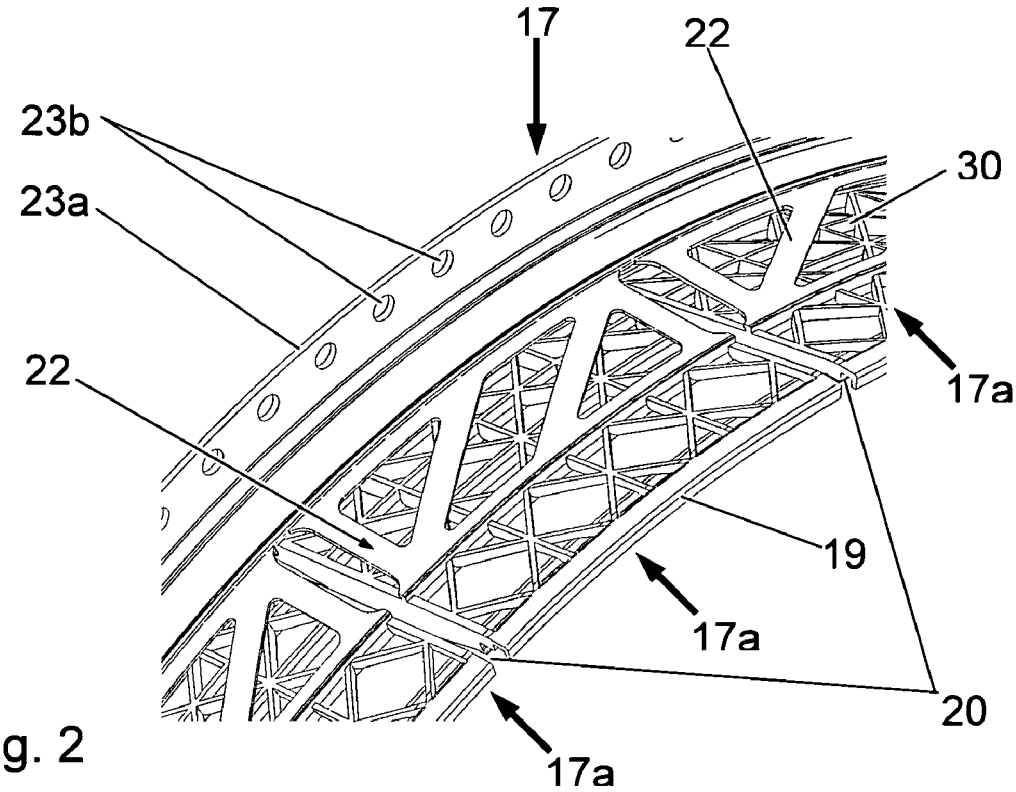
FIG. 2 is an isometric view of a half bridge of the two-part bridge forming a segmented inner casing in the direction of arrowhead A in FIG. 1.

The bridge 16 described in light of the FIGS. 1 and 2, including the first half bridge 17 and the second half bridge 18 into which the second shroud segments 8*b* and the second stator vanes 6 for the second turbine stage are integrated, provides for continuous, "passive" gap width control automatically adapting to variations in thermal expansion also on multi-stage turbines. The supporting elements 19 of the half bridge 17 and the half-bridge elements 18*a* of the second half bridge 18 are stiffened by reinforcing elements 30, 29 such that the forces acting upon the stator vanes 6 can be taken up. The radial position of the first half bridge 17 and of the second half bridge 18 or the half-bridge elements 18*a*, respectively, is determined by their location on the outer platform 9 and the outer platform 11. Any thermal expansion of the bridge 16 is taken up by the circumferential gaps 20 between the supporting elements 19 and by the radial gap 24. While the radially flexible links 22 compensate any relative movement between the supporting elements 19 and the attaching ring 23 of the half bridge 17, the radial gap 24 remaining between the supporting elements and the ring provides for thermal compensation. The half bridge 17 takes up the rolling and tilting moments of the second stator vanes 6 integrated into the half-bridge elements 18*a* of the second half bridge 18, with the radially flexible links 22 transmitting the axial and circumferential forces acting upon the second (intermediate) stator vanes 6 into the outer casing 10 via the stiff attaching ring 23 separated from the supporting element 19 by the radial gap 24.

Figure 3:
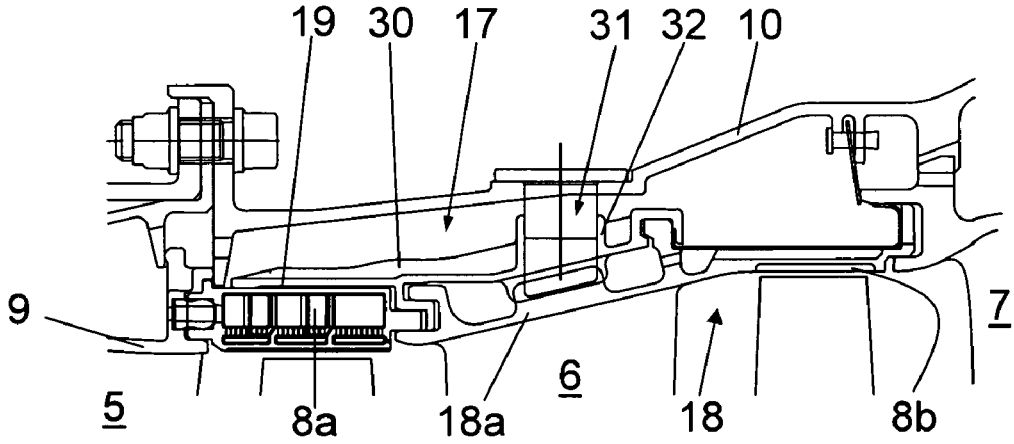
FIG. 3 is another embodiment of a bridge formed by half-bridge elements which is located slideably in the radial direction.

FIG. 3 shows another embodiment of a bridge 16 including two half bridges 17, 18 by means of which the stator vanes 5, 7 immediately upstream and downstream of the rotors 1 and 2 of a two-stage turbine are connected to each other to provide for a passive running gap control adapted to the thermal loading of the rotors. The stiffened supporting elements 19 of the first half bridge 17, arranged with circumferential gaps (not shown) left between them, are each connected to a separately manufactured first shroud segment 8*a* held on the outer platform 9 of the first stator vane 5. The half-bridge elements 18*a* of the second half bridge 18, arranged one behind the other in the circumferential direction and provided with integral second stator vanes 6 and second shroud segments 8*b* each, are axially and radially held on the outer platform 11 of the downstream stator vanes 7 and on the respective supporting element 19 of the first half bridge 17. By means of a guiding pin 31 extending inwards from the outer casing 10 and a guiding sleeve 32 formed onto the half bridge 17, and thus the bridge 16 (17, 18) as a whole, is located slideably in the radial direction, and additionally held axially and circumferentially. A retaining ring 34 (FIG. 4) prevents the bridge from rotating around the guiding pin 31.

Figure 4:
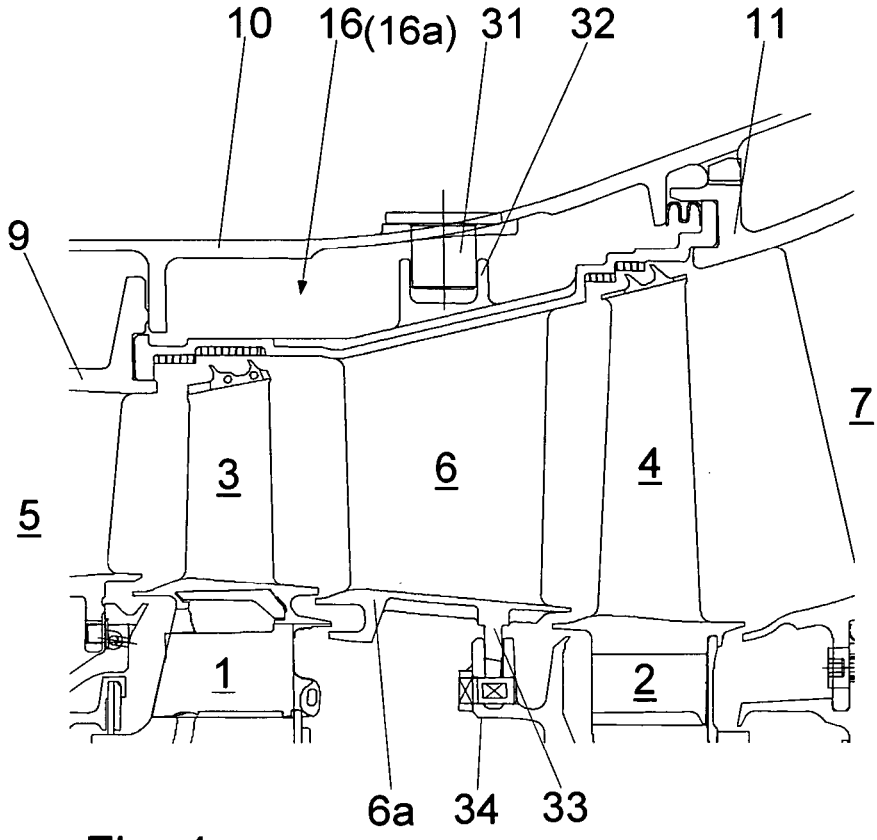
FIG. 4 is a one-piece full bridge consisting of full-bridge elements located slideably in the radial direction, with shroud segments integral with the full bridge and intermediate stator vanes.
Figure 5:
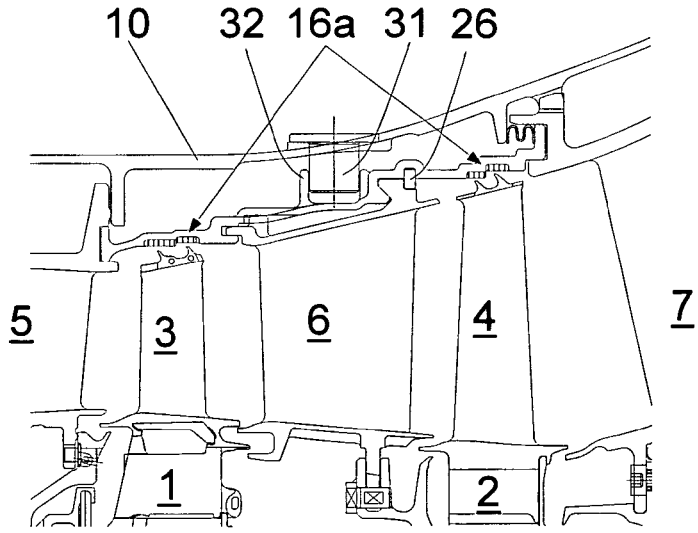
FIG. 5 is a full bridge according to FIG. 4, but with the stator vane being provided separately on the respective full-bridge element.
Figure 6:
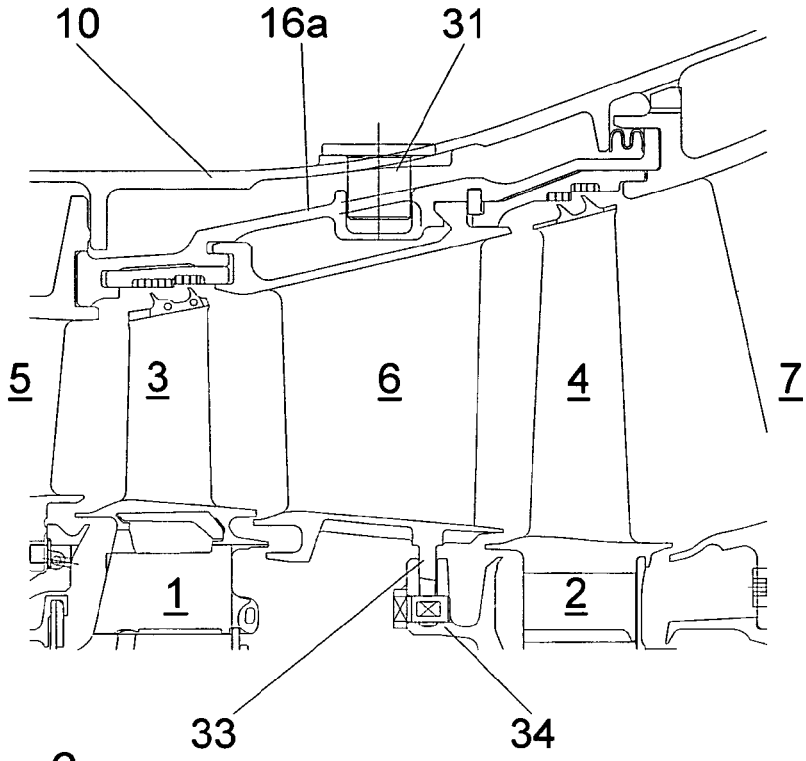
FIG. 6 is a full bridge according to FIG. 4, in which the shroud segments of the first stage are separately manufactured and attached to the full-bridge element.

FIGS. 4, 5 and 6 show embodiments of the inventive assembly of stator vanes to stator vanes by means of a bridge 16 connecting the stator vanes 5, 7 for passive running gap control on a two-stage turbine, in which the circumferentially arranged bridge elements form a one-piece bridge 16 (full bridge), and the individual full-bridge elements 16*a*—as in the embodiment according to FIG. 3—are radially located by means of a guiding pin 31 extending from the casing 10 and a guiding sleeve 32 formed onto the full-bridge elements 16*a*.

In the embodiment according to FIG. 4, the first and second shroud segments 8*a*, 8*b* and the second (intermediate) stator vanes 6 are an integral part of the full-bridge element 16*a*. The full-bridge elements 16*a* are held at the ends in the outer platform 9 of the first stator vanes 5 and the outer platform 11 of the stator vanes 7 arranged downstream of the second rotor 2 to take up the tilting and rolling moments originating at the second stator vanes 6. The second stator vanes 6, which are integral with the full-bridge elements 16*a*, are provided with a locating web 33 at their inner platform 6*a* which engages an annular groove of a circumferential retaining ring 34 to secure the respective second stator vanes 6 against rotation.

The embodiment in FIG. 5 with full-bridge elements 16*a* located slideably in the radial direction (31, 32) differs from the embodiment according to FIG. 4 in that the respective second stator vanes 6 are not integral with the respective full-bridge element 16*a*, but are separably connected to the full-bridge elements 16*a* by means of known fastening structures and, in particular, by means of a fixing ring 26 (see FIG. 1) to take up the axial loads acting upon the second stator vanes 6.

In the case of the full-bridge elements 16*a* located slideably in the radial direction according to FIG. 6—other than in the embodiments to FIGS. 4 and 5—both, the respective second stator vane 6 and the first and second shroud segments 8*a*, 8*b* are provided as separate components.

Figure 7:
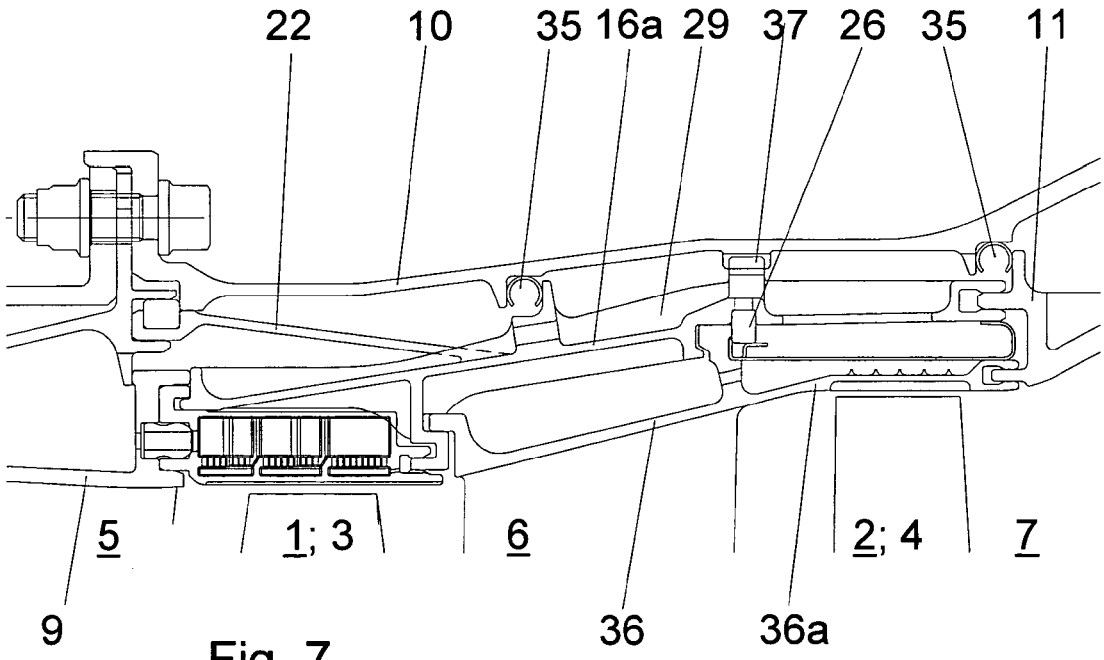
FIG. 7 is a full bridge with supporting elements separately mounted to the full-bridge elements and with integrated stator vane and shroud segment, with the full-bridge elements being held on the outer casing by means of a fixing ring and a radially flexible link connected to the fixing ring.
Figure 8:
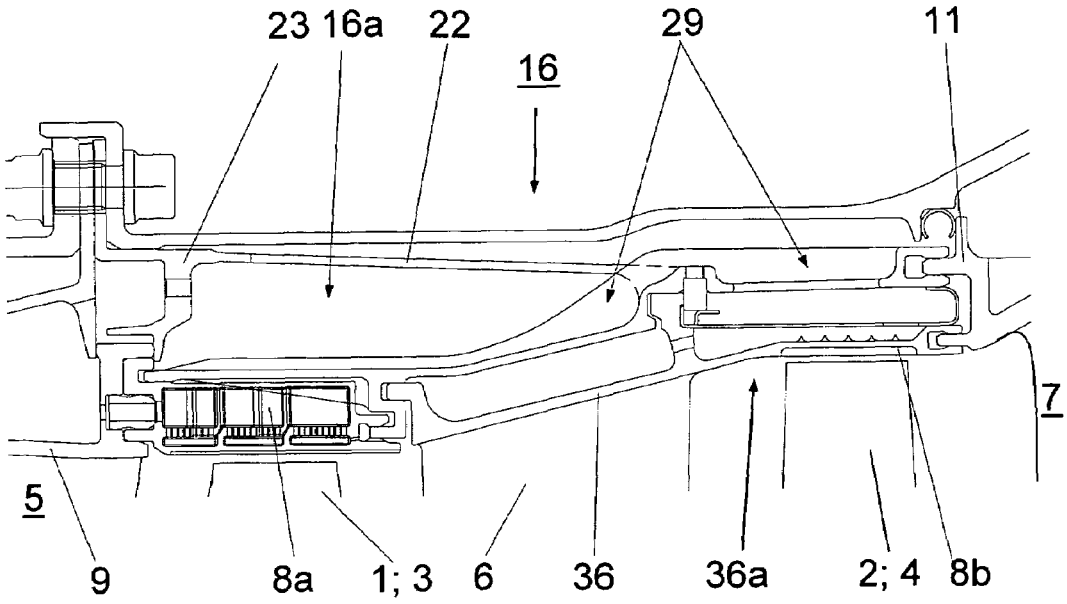
FIG. 8 is a full bridge according to FIG. 7, in which the radially flexible links are firmly connected to a stiff ring attached on the outer casing.

FIGS. 7 and 8 show yet other embodiments of the inventive design with stator vanes assembled to stator vanes by means of a full-bridge element 16*a*. Here, the full-bridge element 16*a* provided with a separate first shroud segment 8*a* is held on the outer platform 9 of the first stator vane 5 and on the outer platform 11 of the outlet-side stator vanes 7. Seals 35 are provided between the outer casing 10 and the full-bridge elements 16*a*. In addition, the full-bridge elements 16*a* provided with bending-resistance by means of reinforcing elements 29 are retained via a radially flexible link 22 either by a fixing ring 26 (FIG. 7) as in the embodiment with a half bridge according to FIG. 1, or by means of a stiff attaching ring 23 (FIG. 8) attached to the outer casing 10, as in the embodiment according to FIG. 1. If axially attached via the fixing ring 26, a transmission element 37 is provided to discharge the bridge circumferential load to the casing 10. The second stator vane 6 and the second shroud segment 8*b* form a one-piece component 36 which is flexible in the connecting area 36*a* between stator vane and shroud segment and which is axially, radially and circumferentially fixed to the bridge element 16*a* and also axially held on the outer platform 11.

List of reference numerals

| | |
|---|---|
| 1 | First rotor |
| 2 | Second rotor |
| 3 | Rotor blade of 1 |
| 3a | Blade tips |
| 4 | Rotor blade of 2 |
| 4a | Blade tips |
| 5 | First (upstream) stator vanes |
| 6 | Second (intermediate) stator vanes |
| 6a | Inner platform |
| 7 | Downstream stator vanes |
| 8a, 8b | First/second shroud segments |
| 9 | Outer platform of 5 |
| 10 | Outer casing |
| 11 | Outer platform of 7 |
| 12 | Double arrow (radial movement) |
| 13 | Double arrow (radial movement) |
| 14 | First running gap |
| 15 | Second running gap |
| 16 | Bridge |
| 16a | Full-bridge element |
| 17 | First half bridge |
| 18 | Second half bridge |

-continued

| List of reference numerals | |
|---|---|
| 17a, 18a | Half-bridge element |
| 19 | Supporting elements of 17 |
| 20 | Circumferential gap of 17 |
| 21 | Mount of 19 |
| 22 | Radially flexible link |
| 23 | Stiff attaching ring of 17 |
| 23a | Mounting flange |
| 23b | Hole |
| 24 | Radial gap of 17 |
| 25 | Web of 18a |
| 26 | Fixing ring |
| 27 | Abutment |
| 28 | Locating pings |
| 29 | Reinforcing elements of 18 |
| 30 | Reinforcing elements of 17 |
| 31 | Guiding pin |
| 32 | Guiding sleeve |
| 33 | Locating web |
| 34 | Retaining ring |
| 35 | Seal |
| 36 | One-piece component (supporting element) |
| 36a | Flexible connecting area |
| 37 | Transmission element |

What is claimed is:

1. An arrangement for automatic running gap control on a turbine having at least two stages, comprising first and second rotors within an outer casing, shroud segments moveably arranged around the rotors, stator vanes positioned upstream, between and downstream of these rotors, a bridge connecting the upstream and downstream stator vanes at outer platforms thereof, the bridge being axially and circumferentially fixed and radially located on the outer casing, the intermediate stator vanes and shroud segments being attached to the bridge;

wherein the bridge includes a plurality of circumferentially arranged bridge elements and the bridge elements are each located on the outer casing by radially flexible links which form a segmented inner casing, with a separate supporting element, which is radially, axially and circumferentially fixed on each bridge element, being integrally connected to the respective intermediate stator vane and the second shroud segment.

2. An arrangement in accordance with claim 1, wherein the bridge includes a first half bridge and a second half bridge which is axially, radially and circumferentially held on the first half bridge, with the intermediate second stator vanes being integrally connected to the second half bridge.

3. An arrangement in accordance with claim 2, wherein the first half bridge comprises a multitude of bending-resistant, circumferentially arranged supporting elements, with a circumferential gap provided between each of them, and a stiff attaching ring attached to the outer casing of the turbine to which the supporting elements are connected via radially flexible links, with a radial gap provided between the free ends of the ring and the supporting elements.

4. An arrangement in accordance with claim 3, comprising a spilt ring fixing ring for axial fixation between the supporting elements and the half-bridge elements.

5. An arrangement in accordance wit claim 3, wherein the supporting elements and the half-bridge elements are stiffened by reinforcing elements.

6. An arrangement in accordance with claim 1, wherein each bridge element is a full-bridge element which locates, at free ends thereof, in the outer platforms of the upstream and the downstream stator vanes.

7. An arrangement in accordance with claim 6, wherein the intermediate stator vanes are integrally connected to the full-bridge elements.

8. An arrangement in accordance with claim 6, wherein the intermediate stator vanes are separate connected to the full-bridge elements.

9. An arrangement in accordance with claim 6, wherein the radially flexible links are held at the outer casing by a groove provided at their end and a fixing ring, and the full-bridge elements are circumferentially held on the outer casing.

10. An arrangement in accordance with claim 6, wherein the radially flexible links are firmly connected to a stiff attaching ring attached to the outer casing.

11. An arrangement in accordance with claim 6, wherein the supporting element for the intermediate stator vane and the shroud segment includes a flexible connecting area.

12. An arrangement in accordance with claim 1, comprising seals positioned between the outer platform of the downstream stator vanes and the outer casing.

13. An arrangement in accordance with claim 6, comprising seals positioned between the full-bridge element and the outer casing.

14. An arrangement in accordance with claim 6, comprising a split ring fixing ring for axial fixation between the full-bridge elements and the separate intermediate stator vanes.

15. An arrangement in accordance with claim 6, wherein the full-bridge elements are stiffened by reinforcing elements.

16. An arrangement in accordance with claim 1, wherein the radially flexible links are held at the outer casing by a groove provided at their free end and a fixing ring, and the bridge elements are circumferentially held on the outer casing.

17. An arrangement in accordance with claim 1, wherein the radially flexible links are firmly connected to a stiff attaching ring attached to the outer casing.

18. An arrangement in accordance with claim 1, wherein the supporting element for the intermediate stator vane and the shroud segment includes a flexible connecting area.

* * * * *